US005692277A

United States Patent [19]

Chen

[11] Patent Number: 5,692,277

[45] Date of Patent: Dec. 2, 1997

[54] SEALING DEVICE OF CINERARY URN

[76] Inventor: To Ming Chen, No. 1, Alley 40, Lane 161, Ku Shan 1 Road, Kaohsiung, Taiwan

[21] Appl. No.: 604,051

[22] Filed: Feb. 20, 1996

[51] Int. Cl.[6] ..... A61G 17/00

[52] U.S. Cl. ..... 27/17; 27/DIG. 1

[58] Field of Search ..... 27/1, 14, 17, DIG. 1; 277/189, 228, 233; 215/275; 220/319, 320, 356, 357

[56] References Cited

U.S. PATENT DOCUMENTS

| | | | |
|---|---|---|---|
| 2,177,359 | 10/1939 | Baker | 220/319 X |
| 3,311,256 | 3/1967 | Dowling et al. | 220/319 |
| 5,172,457 | 12/1992 | Allen et al. | 27/1 |
| 5,287,603 | 2/1994 | Schorman | 27/1 |

*Primary Examiner*—Kien T. Nguyen
*Attorney, Agent, or Firm*—David & Raymond; Raymond Y. C. Chan

[57] ABSTRACT

A sealing device of a cinerary urn includes a sealing strip and a photo frame. The sealing strip is a flexible thin strip having a length at least equal to the circumference of the cinerary urn for firmly adhering onto the junction of the cover and the body of the cinerary urn. A central portion of the sealing strip forms a receiving groove at its lower edge. Two inner corners of the receiving groove form a right and a left short slit respectively and thus defines a right holding lip and a left holding lip respectively. The photo frame including a transparent frame body and a rigid bottom plate, in which the frame body has a concave receiving chamber and defines a periphery rim around the receiving chamber, and the bottom plate is connected with the frame body by affixing a front surface of the bottom plate to the periphery rim of the frame body for receiving a picture of the dead within the receiving chamber of the frame body, a back surface of the bottom plate having a layer of adhesive material for adhering onto the cinerary urn. The top edge of the receiving groove is aligned with the top side of the photo frame and the two lips are capable of holding the photo frame more firmly in position. Whereby, the sealing of the cinerary urn is standardized and becomes more durable.

8 Claims, 7 Drawing Sheets

SEALING DEVICE OF CINERARY URN

BACKGROUND OF THE PRESENT INVENTION

The present invention relatives to cinerary urn, and more particularly to a sealing device which comprises a sealing strip for firmly attaching the cover of the cinerary urn to the container body of the cinerary urn and a photo frame unit for protecting the photograph or printing of the deceased from exposed in air.

The ashes of the dead after cremation are usually collected and reserved in a cinerary urn, as shown in FIG. 1. Conventional cinerary urn 1 is generally made of marble or the like and comprises a cylindrical container body 2 for receiving ashes of the dead and a cylindrical cover 3 for coveting a top opening 4 of the container body 2 by coupling with a periphery rim 5 protruded upwardly from the top opening 4. Since the cover 3 is merely placed on the container body 2 without any connecting means provided, a common adhesive plaster or adhesive tape is often applied along the junction line between the cover 3 and the container body 2 for further attachment. It is well known that such conventional plastic adhesive tape is designed to attach light weight matters such as papers only. However, the marble cinerary urn 1 and the ashes therein contribute a heavy weight that such conventional plastic adhesive tape is not able to firmly attached the cover 3 to the container body 2. Accordingly, there is a high hazard of causing overturning of the cinerary urn 1 if the son in mourning just holds on the cover 3 of the cinerary urn 1. Moreover, such simple and crude plastic adhesive tape does not harmonize with the solemn cinerary urn 1.

Besides, since the cinerary urn 1 is generally exposed in air, the simple and crude adhesive tape will be hardened and oxidized and become faded and discolored after exposing in air for long time. The oxidation of the adhesive tape may cease its adhering ability that the ashes, which should be reserved in absolutely dry condition, contained therein will be humidified by the damp.

Conventional cinerary urn further has a vertical flat surface 6 formed in an upper portion of the container body 2 for adhering a ceramic photo 7 of the deceased for memorial purpose. The ceramic photo 7 is made by sintering a photograph of the dead with ceramic material to form a rectangular piece having a thickness of about 5–6 mm. Such ceramic photo is simply adhered to the flat surface 6 after the application of the adhesive tape to the cinerary urn 1, the weight of the ceramic photo 7 may cause dislocation or even dropping off of the ceramic photo later or sooner.

In fact, the ceramic photo 7 may blur out the picture and it is costly to produce a color ceramic photo. Moreover, since the ceramic photo 7 is exposed in air and even sunshine, sooner or later, the picture may fade away and a plurality of cracks may occur on the surface. Such conventional ceramic photo 7 is unable to make any ornamental thereon and thus it is dull in appearance. The aforesaid shortcomings of the ceramic photo also exist when it is stuck on a gravestone.

SUMMARY OF THE PRESENT INVENTION

The main object of the present invention is to provide a sealing device of cinerary urn which enables the sealing of the cinerary urn to standardize and become durable.

Another object of the present invention is to provide a sealing device of cinerary urn which is protected from oxidation so that its adhesive ability can be maintained.

Another object of the present invention is to provide a sealing device of cinerary urn which is easy to operate and is able to provide various permanent ornamentals.

Another object of the present invention is to provide a sealing device of cinerary urn which comprises a photo frame to receive the photograph or even the ceramic photo of the dead. The photo frame is capable of protecting the photograph or ceramic photo from fadeaway and providing an enlargement effect for the picture of the dead that may provide a more distinct image of the dead.

Another object of the present invention is to provide a sealing device of cinerary urn, comprising a sealing strip which has a receiving groove adapted to hold a photo frame firmly in position.

Accordingly, the present invention provides a sealing device of a cinerary urn which includes a sealing strip and a photo frame. The sealing strip is a flexible thin strip having a length at least equal to the circumference of the cinerary urn for firmly adhering onto the junction of the cover and the body of the cinerary urn. A central portion of the sealing strip forms a receiving groove at its lower edge. Two inner corners of the receiving groove form a right and a left short slit respectively and thus defines a right holding lip and a left holding lip respectively. The photo frame including a transparent frame body and a rigid bottom plate, in which the frame body has a concave receiving chamber and defines a periphery rim around the receiving chamber, and the bottom plate is connected with the frame body by affixing a front surface of the bottom plate to the periphery rim of the frame body for receiving a picture of the dead within the receiving chamber of the frame body, a back surface of the bottom plate having a layer of adhesive material for adhering onto the cinerary urn. The top edge of the receiving groove is aligned with the top side of the photo frame and the two lips are capable of holding the photo frame more firmly in position. Whereby, the sealing of the cinerary urn is standardized and becomes more durable.

DETAILED DESCRIPTION OF THE PREFERRED EMBODIMENT

Figure 1:
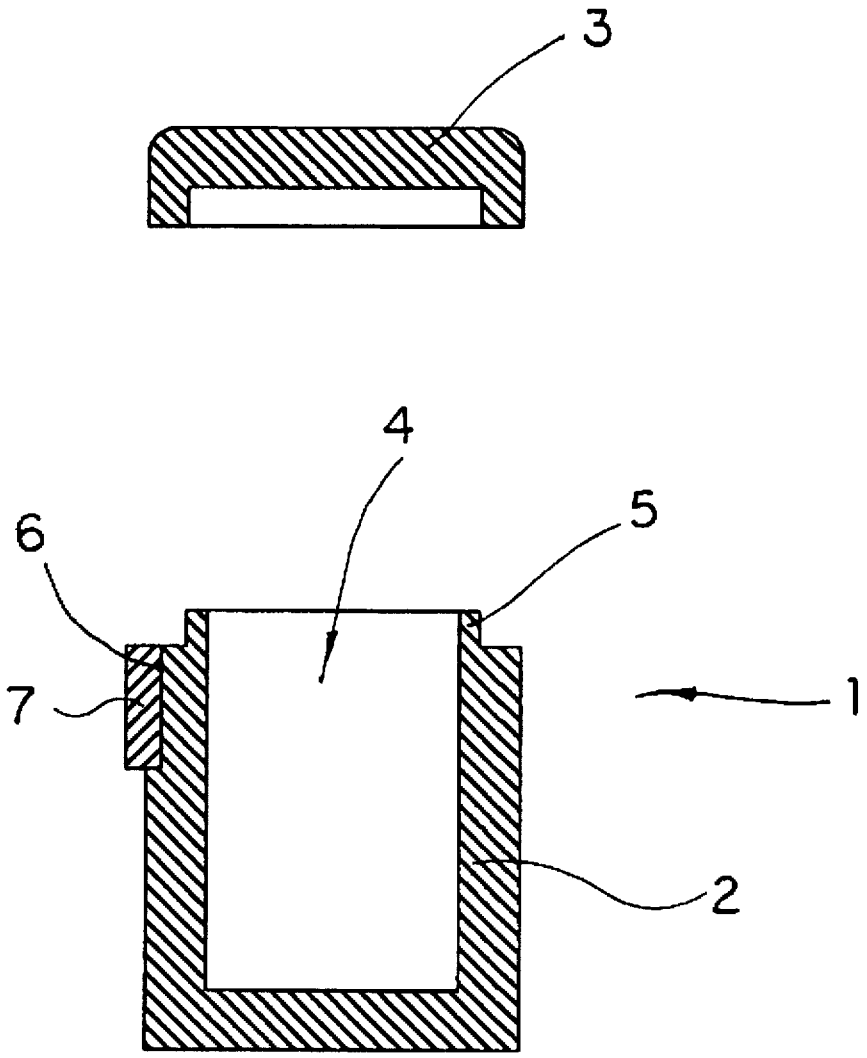
FIG 1 PRIOR ART
FIG. 1 is a sectional view of a cinerary urn with a ceramic photo attached thereon.
Figure 2:
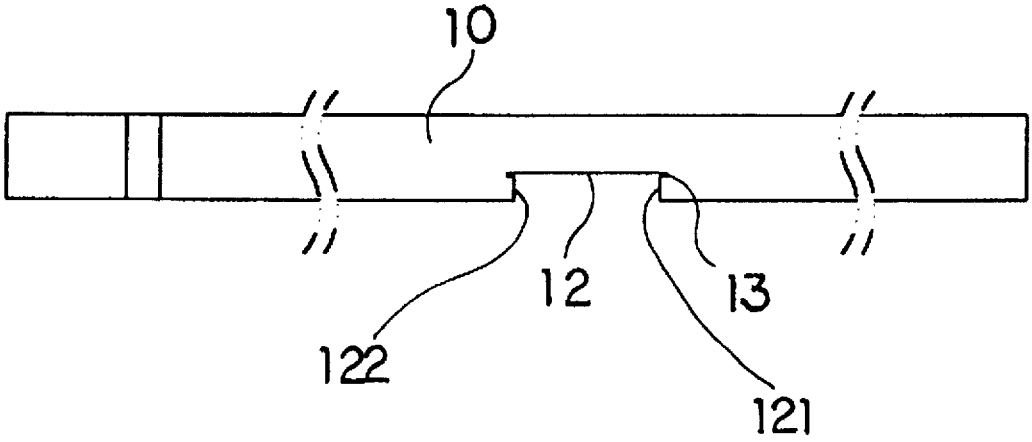
FIG. 2 is a front view of a sealing strip according to a preferred embodiment of the present invention.
Figure 3:
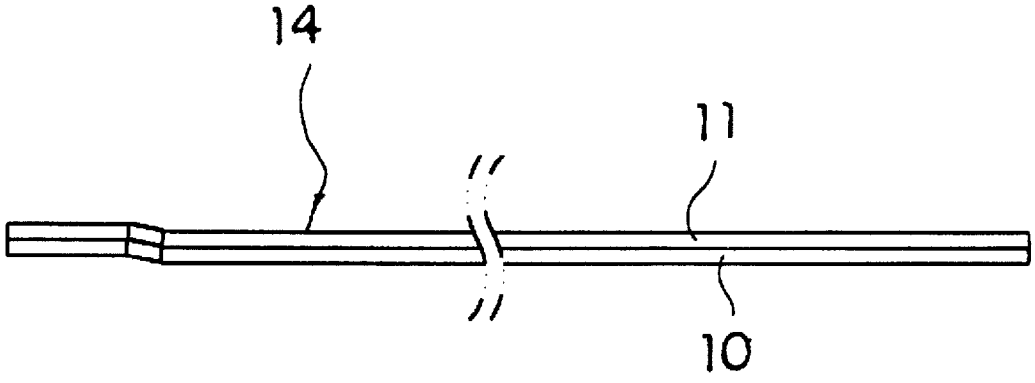
FIG. 3 is a plan view of the sealing strip according to the above embodiment of the present invention.

Referring to FIG. 2 and 3 of the drawings, a sealing device comprises a sealing strip 10 which is a flexible thin strip having a length at least equal to the circumference of the cinerary urn. The sealing strip 10 is preferred to be made of aluminum or aluminum alloy strip with designated ornamental pattern printed on its front side surface. The surface (s) of such aluminum sealing strip 10 is better to reinforce by positive electricity treatment to prevent oxidation. The back side of the sealing strip 10 provides a layer of strong adhesive material 11. The central portion of the sealing strip 10 is cut away a rectangular portion to define a receiving groove 12 at the lower edge. Two inner corners of the receiving groove 12 form a right and a left short slit 13 respectively. The two slits 13 are slightly cut transversely from the right and left inner corners of the receiving groove 12 respectively. Accordingly, the fight and left sides of the receiving groove 12 form a right holding lip 121 and a left holding lip 122 respectively. Before application, a paper strip 14 is attached to the adhesive back side surface of the sealing strip 10 for protection and reservation.

Figure 4:
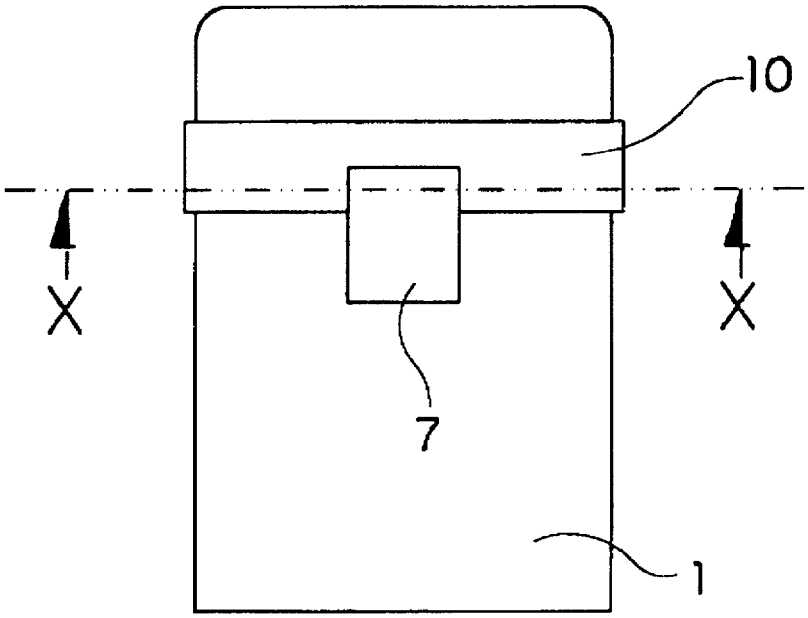
FIG. 4 is a front view of a cinerary urn with a ceramic photo attached thereon, in which the sealing strip according to the above embodiment of the present invention is adhered to attach the cover of the cinerary urn and hold the ceramic photo in position.
Figure 5:
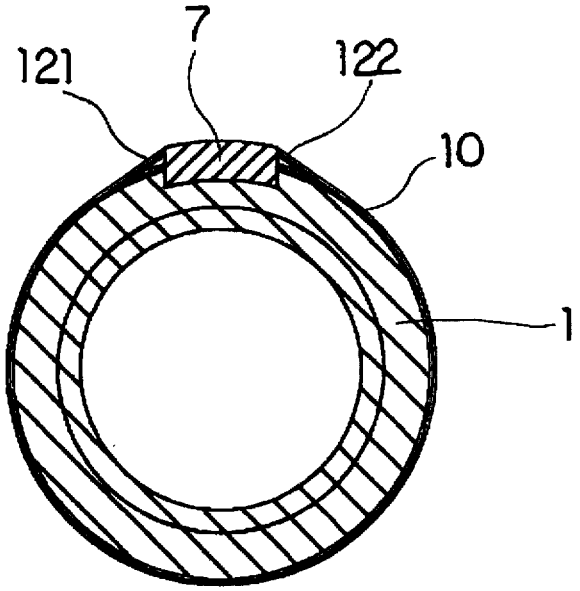
FIG. 5 is a sectional plan view along the sectional line X—X in FIG. 4.

To a cinerary urn 1 having a ceramic photo 7 attached thereon, as shown in FIG. 4 and 5, the width of the receiving groove 12 should be slightly smaller than width of the ceramic photo 7. To apply the sealing strip 10 onto the cinerary urn, firstly, tear away the paper strip 14 and simply align the top edge of the receiving groove 12 with the top side of the ceramic photo 7, as shown in FIG. 4. The right holding lip 121 and the left holding lip 122 will then be abutted against the right and left sides of the ceramic photo 7, as shown in FIG. 5. When the two holding lips 121, 122 are pressed down to adhere on the cinerary urn's curve surface, the ceramic photo 7 is thus firmly held in position. Afterward, the rest of the sealing strip 10 can simply be adhered along the junction of the cover and the body of the cinerary urn 1.

Figure 6:
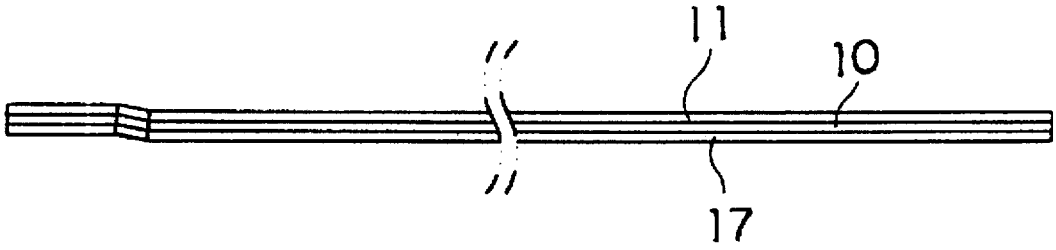
FIG. 6 is a plan view of an alternative mode of the sealing strip according to the above embodiment of the present invention.

For better reservation and further isolation from air, as shown in FIG. 6, a transparent plastic protecting strip 17 is attached to the front side surface of the sealing strip 10 so that the ornamental pattern printed on the front side surface of the sealing strip 10 will not fade away.

Figure 7:
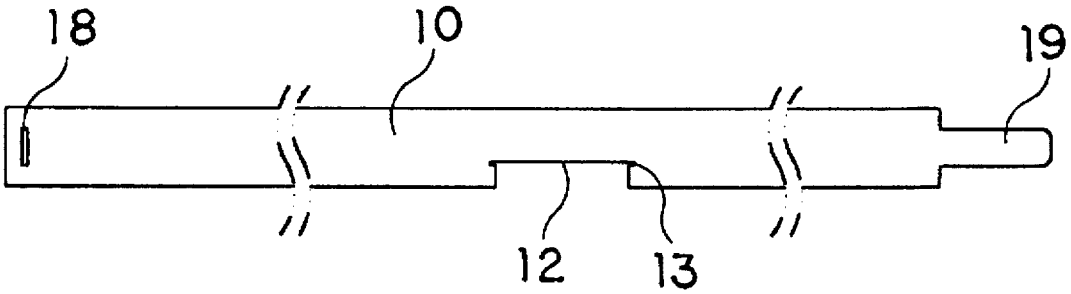
FIG. 7 is a front view of a modified mode of the sealing strip according to the above embodiment of the present invention.

Referring to FIG. 7, a modified mode of the sealing strip 10 is illustrated, in which one end of the sealing strip 10 forms a buckle slot 18 and another end of the sealing strip 10 defines a buckle tail 19 adapted to penetrate through the buckle slot 18 and to fold backward in order to further ensure the attachment of the sealing strip 10.

Figure 9:
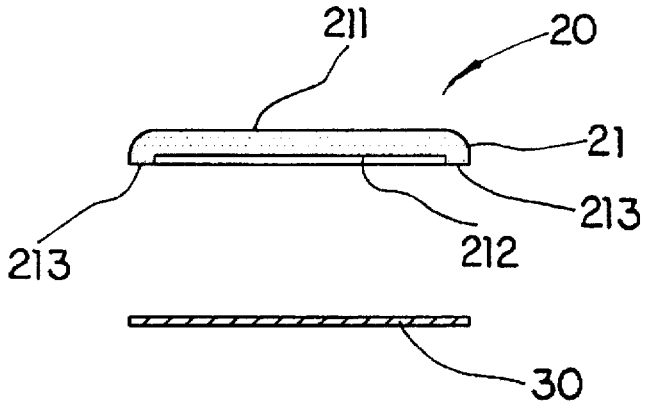
FIG. 9 is a sectional end view of FIG. 8.
Figure 8:
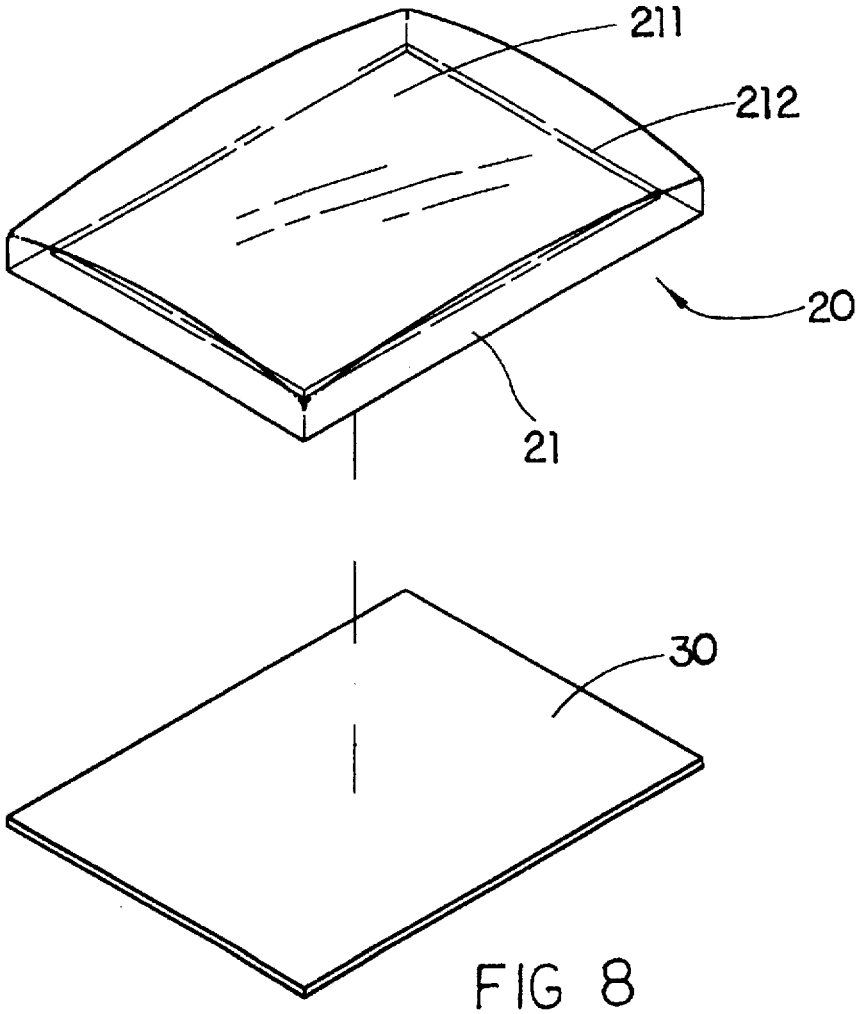
FIG. 8 is an exploded perspective view of a photo frame according to the above embodiment of the present invention.

Referring to FIGS. 8 and 9, the sealing device of the present invention further comprises a photo frame 20. The photo frame 20 comprises a plastic made transparent frame body 21 and a rigid metal bottom plate 30. A front surface of the frame body 21 is a convex surface 211 extending from one longitudinal side to another opposite longitudinal side. A back surface of the frame body 21 has a concave rectangular receiving chamber 212 and defines a rectangular periphery rim 213 (as shown in FIG. 9) around the receiving chamber 212. A predetermined ornamental pattern is printed on a bottom surface of the periphery rim 213 for decoration. The bottom plate 30 has a length and a width equal to that of the frame body 21. Each of the from and back surfaces of the bottom plate 30 respectively has a layer of adhesive material which can be protected by a protecting paper. Accordingly, a picture of the dead having a size accommodated with the size of the receiving chamber 212 is placed in the receiving chamber 212. Tear off the protecting papers and stick the front adhesive surface of the bottom plate 30 onto the back surface of the picture and the bottom surface of the periphery rim 213, so that the picture of the dead is sealed within the receiving chamber 212 to isolate from air in order to prevent the fadeaway of the picture. Furthermore, the convex front surface 211 of the frame body 21 provides an enlargement effect that may provide a more distinct image of the dead.

Figure 11:
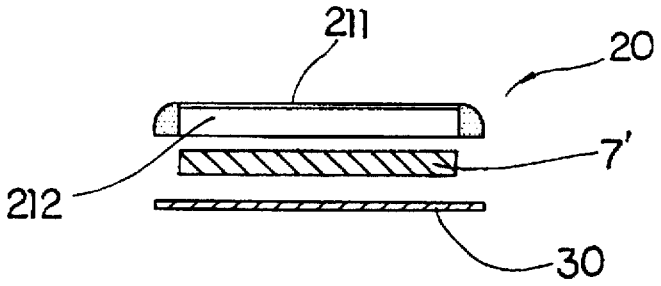
FIG. 11 is a sectional end view of FIG. 10.
Figure 10:
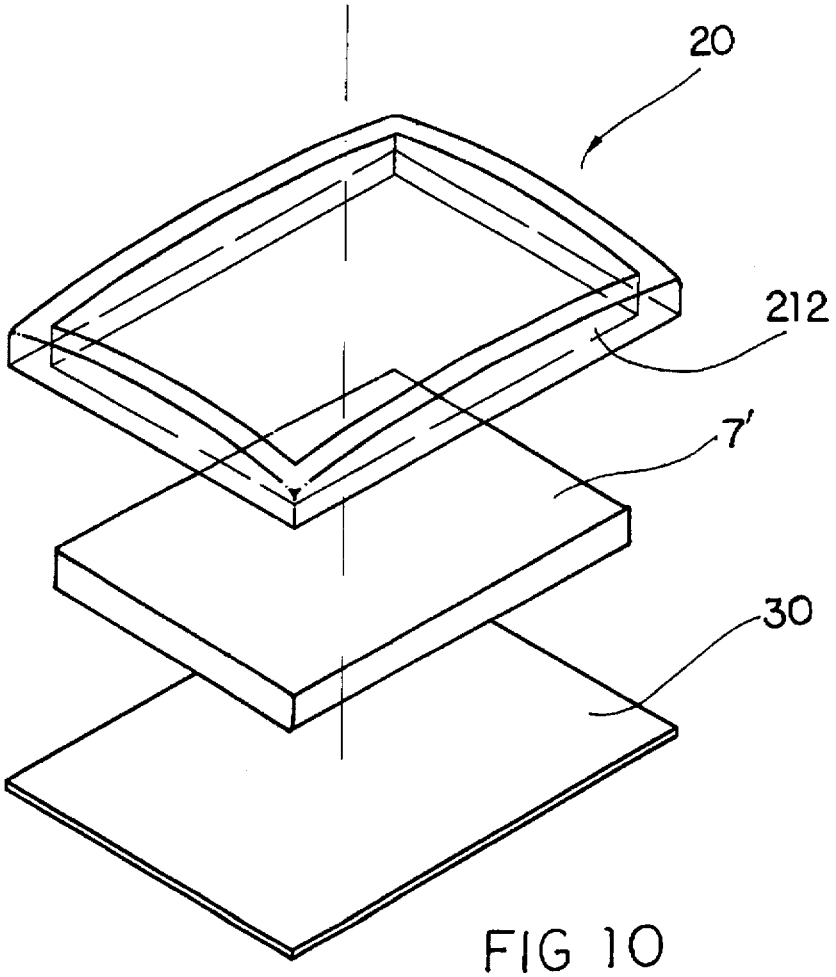
FIG. 10 is an exploded perspective view of an alternative mode of the photo frame according to the above embodiment of the present invention.

The photo frame 20 as disclosed above is also accommodated with a ceramic photo 7'. As shown in FIGS. 10 and 11, an alternative mode of the photo frame 20 is illustrated, wherein the depth of the receiving chamber 212 should be at least equal to the thickness of the ceramic photo 7' and the front surface 211 of the frame body 21 is as thin as possible.

Figure 13A:
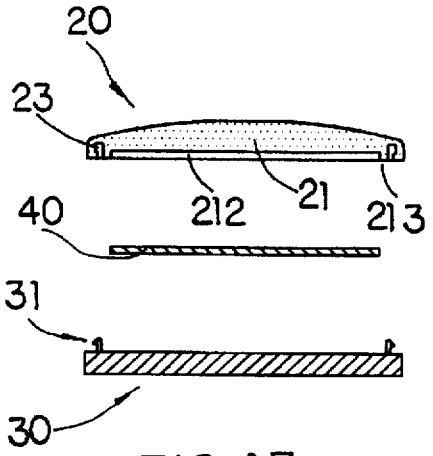
FIG. 13*a* is a sectional end view of FIG. 12.
Figure 13B:
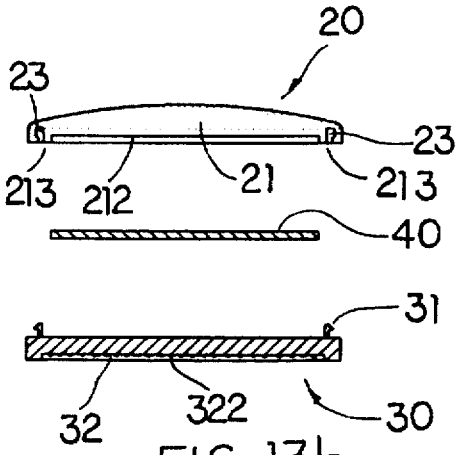
FIG. 13*b* is a sectional end view of an alternative mode of FIG. 13*a*.
Figure 12:
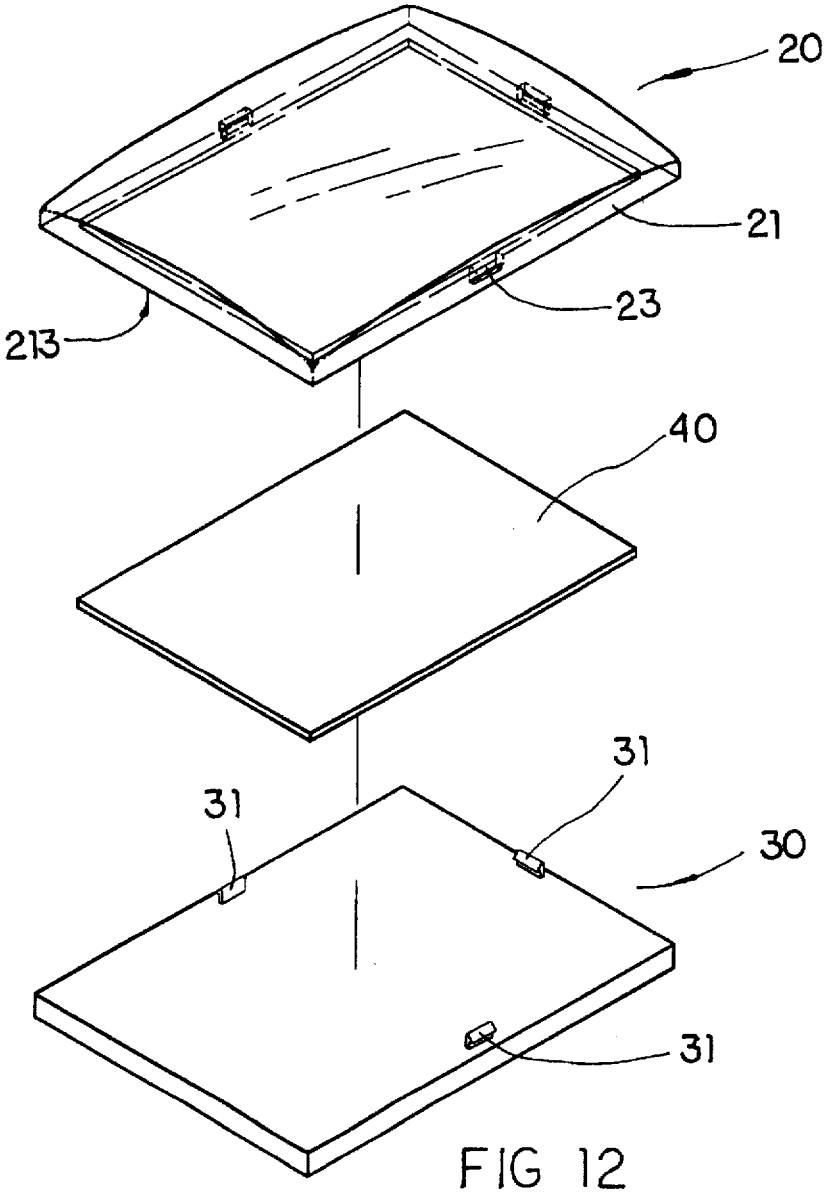
FIG. 12 is an exploded perspective view of another alternative mode of the photo frame accommodated for the ceramic photo according to the above embodiment of the present invention.

Referring to FIGS. 12 and 13*a*, another alternative mode of the photo frame 20 is illustrated. The photo frame 20 further comprises at least two buckle socket 23 formed on two opposite sides of the periphery rim 213 respectively and two buckles 31 protruded on two corresponding opposite edges of the front surface of the bottom plate 30. A picture 40 of the dead can be placed within the receiving chamber 212 and the bottom plate 30 is mounted on to the frame body 21 by buckling the buckles 31 into the buckle socket 23 for firmly holding the frame body 21 and the bottom plate 30 together to form an integral body. As shown in FIG. 13*b*, an alternative mode is illustrated, wherein the back surface of the bottom plate 30 has a concave shallow groove 32 which may be provided with a plurality of protruding teeth 322. A layer of adhesive can be applied to the shallow groove 32 when the photo frame 20 is ready to adhere onto the surface of the cinerary urn or a grave. However, a layer of cement can be applied to the shallow groove 32 for firmly affixing the photo frame 20 onto a photo groove provided on the gave or the cinerary urn.

The operation of the sealing device of the present invention is easy and quick. Firstly, adhere the photo frame 20 onto a desired vertical flat surface provided on the cinerary urn 1. The width of the receiving groove 12 should be slightly smaller than width of the photo frame 20. Secondly, tear away the paper strip 14 and simply align the top edge of the receiving groove 12 with the top side of the photo frame 20. The fight holding lip 121 and the left holding lip 122 will then be abutted against the fight and left sides of the photo frame 20. When the two holding lips 121, 122 are pressed down to adhere on the cinerary urn's curve surface, the photo frame 20 is thus firmly held in position. Afterward, the rest of the sealing strip 10 can simply be adhered along the junction of the cover and the body of the cinerary urn 1.

In accordance with the above disclosure, the sealing device of the present invention is specifically adapted to the cylindrical cinerary urn and is capable of enhancing the following practical results:

1. The sealing device of cinerary urn enables the sealing of the cinerary urn to standardize and become durable.
2. The sealing device of cinerary urn is protected from oxidation so that its adhesive ability can be maintained.
3. The sealing device of cinerary urn is easy to operate and is able to provide various permanent ornamentals.

4. The photo frame of the sealing device of cinerary urn is provided to receive the (color) photograph or even the ceramic photo of the dead. The photo frame is capable of protecting the photograph or ceramic photo from fadeaway and providing an enlargement effect for the picture of the dead that may provide a more distinct image of the dead.

5. The presentation of the holding lips and the receiving groove of the sealing strip enables the sealing strip to hold the photo frame firmly in position.

I claim:

1. A sealing device of a cinerary urn, comprising a sealing strip which is a flexible thin strip having a length at least equal to the circumference of the cinerary urn, a back side of said sealing strip providing a layer of adhesive material for attaching around the cinerary urn, a central portion of said sealing strip forming a receiving groove at its lower edge, a right and a left side of said receiving groove forming a right holding lip and a left holding lip respectively for abutting against two sides of a photo frame.

2. A sealing device, as recited in claim 1, in which two inner corners of said receiving groove form a right and a left short slit respectively which are slightly cut transversely from the right and left inner corners of said receiving groove respectively to define said right and left holding lips.

3. A sealing device, as recited in claim 1, in which a front side surface of said sealing strip provides an ornamental pattern thereon.

4. A sealing device, as recited in claim 1, in which said sealing strip is made of aluminum or aluminum alloy strip.

5. A sealing device, as recited in claim 4, in which at least a surface of said aluminum sealing strip is reinforced by positive electricity treatment.

6. A sealing device, as recited in claim 1, furthering comprising a paper strip which is attached to the adhesive back side of said sealing strip.

7. A sealing device, as recited in claim 1, further comprising a transparent plastic protecting strip attaching to a front side surface of said sealing strip.

8. A sealing device, as recited in claim 1, in which one end of said sealing strip forms a buckle slot and another end of said sealing strip defines a buckle tail adapted to penetrate through said buckle slot and to bend backward in order to further ensure the attachment of said sealing strip.

* * * * *